US006528936B1

(12) United States Patent
Lee et al.

(10) Patent No.: US 6,528,936 B1
(45) Date of Patent: Mar. 4, 2003

(54) CATHODE RAY TUBE WITH FUNNEL CONE THICKNESS VARIATIONS

(75) Inventors: Bong-Woo Lee, Kyungki-do (KR); Chan-Yong Kim, Kyungki-do (KR)

(73) Assignee: Samsung Display Devices Co., Ltd, Suwon-si (KR)

( * ) Notice: Subject to any disclaimer, the term of this patent is extended or adjusted under 35 U.S.C. 154(b) by 0 days.

(21) Appl. No.: 09/435,275

(22) Filed: Nov. 5, 1999

(30) Foreign Application Priority Data

Nov. 10, 1998 (KR) ..... 98-48060

(51) Int. Cl.[7] ..... H01J 31/00

(52) U.S. Cl. ..... 313/477 R; 313/477 HC; 445/45

(58) Field of Search ..... 313/477 R, 477 HC, 313/318.05, 602, 616, 618; 439/602, 616, 618; 445/45

(56) References Cited

U.S. PATENT DOCUMENTS 3,731,129 A * 5/1973 Tsuneta et al. ..... 313/64
5,568,011 A * 10/1996 Ragland, Jr. et al. ... 313/477 R
5,751,103 A * 5/1998 Opresko et al. ..... 313/477 R
6,316,871 B2 * 11/2001 Park ..... 313/412
6,323,591 B1 * 11/2001 Oosterhout et al. ..... 313/477 R
6,359,379 B1 * 3/2002 Lee et al. ..... 220/2.1 A
6,380,668 B1 * 4/2002 Kim et al. ..... 220/2.1 A

* cited by examiner

*Primary Examiner*—Ashok Patel
*Assistant Examiner*—Glenn Zimmerman
(74) *Attorney, Agent, or Firm*—Christie, Parker & Hale, LLP

(57) ABSTRACT

A cathode ray tube with a central tube axis Z includes a panel with an inner phosphor screen and a rear portion. The panel has a substantially rectangular effective screen portion with two long sides in a horizontal axis direction, two short sides in a vertical axis direction and four edges in a diagonal axis direction. A funnel is connected to the rear portion of the panel. The funnel sequentially has a body with a large-sized end and a small-sized end, and a cone portion with a large-sized end and a small-sized end. The cone portion has a thickness Th in the horizontal axis direction, a thickness Tv in the vertical axis direction and a thickness Td in the diagonal axis direction. The horizontal thickness Th, the vertical thickness Tv and the diagonal thickness Td of the cone portion of the funnel in the tube axis Z direction satisfy the following condition: Th(z)=Tv(z)>Td(z).

17 Claims, 5 Drawing Sheets

CATHODE RAY TUBE WITH FUNNEL CONE THICKNESS VARIATIONS

FIELD OF THE INVENTION

The present invention relates to a cathode ray tube (CRT), and more particularly, to a CRT that can effectively enhance electron beam deflection efficiency.

BACKGROUND OF THE INVENTION

Generally, CRTs include a panel having an inner phosphor screen, a funnel having a cone portion, and a neck having an electron gun therein, that are sequentially connected to each other. A deflection yoke is mounted around the cone portion of the funnel to form horizontal and vertical magnetic fields there. In this structure, electron beams emitted from the electron gun are deflected through the horizontal and vertical magnetic fields from the deflection yoke, and land on the phosphor screen.

Recently, CRTs have been employed for use in highly sophisticated electronic devices such as high definition television (HDTV) and OA equipment.

On the one hand, in these applications, the power consumption of the CRT should be reduced to obtain good energy efficiency. Additionally, the magnetic field leakage due to power consumption should be reduced to protect the user. In order to meet these requirements, the power consumption of the deflection yoke, which is the major source of power consumption, should be reduced in a suitable manner.

On the other hand, in order to realize a high brightness and resolution of display images on the screen, the deflection power of the deflection yoke should increase. Specifically, a higher anode voltage is needed for enhancing the brightness of the screen and, correspondingly, a higher deflection voltage is needed for deflecting the electron beams accelerated by the increased anode voltage. Furthermore, higher deflection frequency is needed for enhancing the resolution of the screen, along with the need for increased deflection power. In addition, in order to realize relatively flat CRTs for more convenient use, wide-angle deflection should be performed with respect to the electron beams. Wide-angle deflection also requires increased deflection power.

In this situation, there are needs for developing techniques for allowing the CRTs to retain good deflection efficiency while constantly maintaining or reducing the deflection power.

Conventionally, a technique of increasing the deflection efficiency positions the deflection yoke to be more adjacent to the electron beam paths. The positioning of the deflection yoke is achieved by reducing a diameter of the neck and an outer diameter of the funnel adjacent to the neck. However, in such a structure, the electron beams to be applied to the screen corner portions are liable to bombard the inner wall of the funnel adjacent to the neck (This phenomenon is usually called the "beam shadow neck" phenomenon or briefly the "BSN" phenomenon). Consequently, the phosphors coated on the corresponding screen corner portions are not excited and it becomes difficult to obtain good quality screen images.

In order to solve such problems, it has been proposed that the cone portion of the funnel, around which the deflection yoke is mounted, be formed with a shape where a circle gradually changes into a rectangle from a neck-side of the funnel to a panel-side. This shape corresponds to the deflection route of the electron beams. In this structure, the size of the cone portion is minimized so that the deflection yoke can be positioned to be more adjacent to the electron beam paths.

However, in the above technique, the cone portion of the funnel is merely designed to be formed with a rectangular shape without considering the practical moving routes of the electron beams in various directions, and thus does not cope with the beam shadow neck (BSN) phenomenon in an appropriate manner.

SUMMARY OF THE INVENTION

It is an object of the present invention to provide a CRT that can effectively enhance electron beam deflection efficiency with appropriate structural components.

This and other objects may be achieved by a CRT with a central tube axis Z. The CRT includes a panel with an effective area and a rear portion. The panel has a substantially rectangular effective screen portion with two long sides in a horizontal axis direction, two short sides in a vertical axis direction and four edges in a diagonal axis direction. A funnel is connected to the rear portion of the panel. The funnel sequentially has a body with a large-sized end and a small-sized end, and a cone portion with a large-sized end and-a small-sized end. The large-sized end of the body is sealed to the rear portion of the panel. The small-sized end of the body meets the large-sized- end of the cone portion at a point. The meeting point of the body and the cone portion becomes an inflection point of the funnel. The cone portion has a thickness Th in the horizontal axis direction, a thickness Tv in the vertical axis direction and a thickness Td in the diagonal axis direction. A neck is sealed to the small-sized end of the cone portion. An electron gun is fitted within the neck to produce electron beams. A deflection yoke is mounted around the cone portion of the funnel. The horizontal thickness Th, the vertical thickness Tv and the diagonal thickness Td of the cone portion of the funnel in the tube axis Z direction satisfy the following condition: $Th(z)=Tv(z)>Td(z)$.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION

Figure 1:
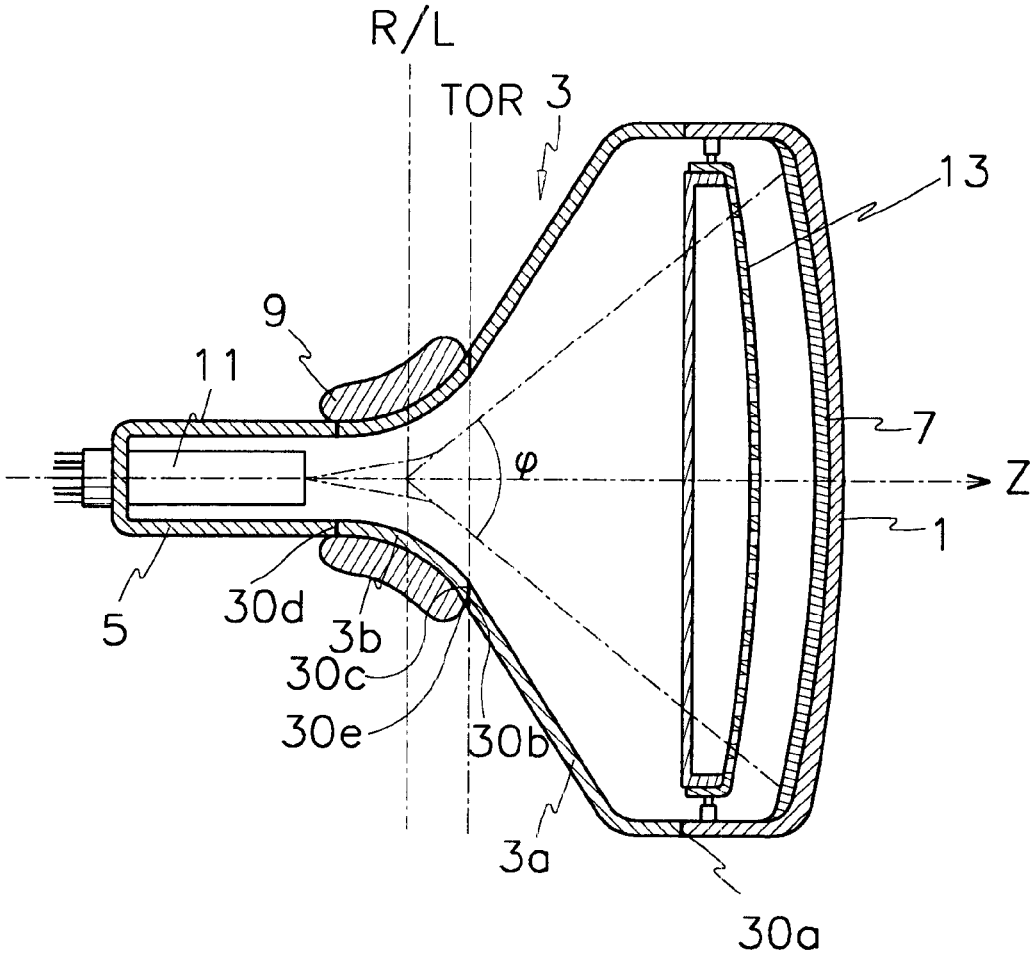
FIG. 1 is a sectional view of a CRT with a panel and a funnel according to a first preferred embodiment of the present invention where the section is taken along a diagonal axis line of the panel.
Figure 2:
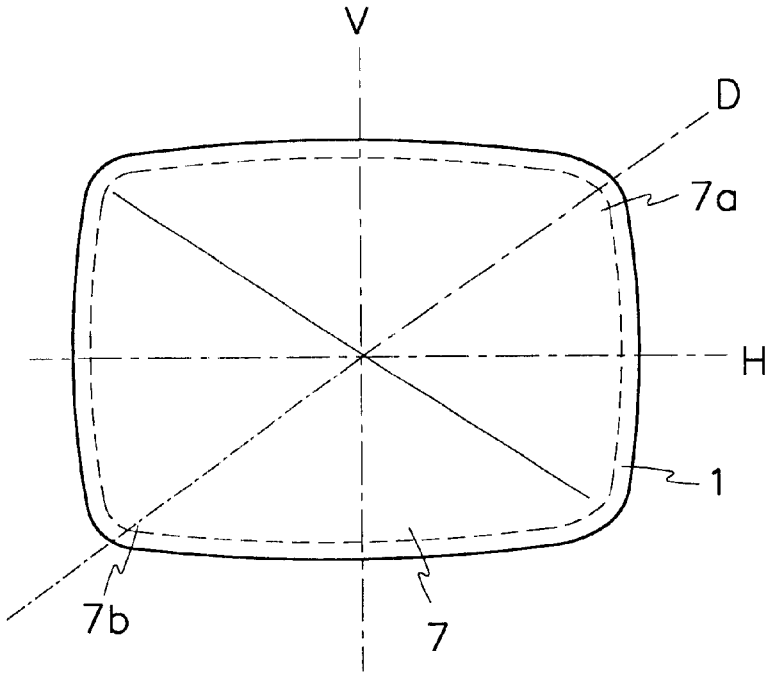
FIG. 2 is a plan view of the panel shown in FIG. 1.

As shown in FIG. 1, a preferred embodiment of a panel 1 has a substantially rectangular effective screen portion with two long sides in a horizontal direction and two short sides in a vertical direction and four edges in a diagonal direction. In the drawings, Z indicates a central tube axis of the CRT hereinafter referred to as the "tube axis", H indicates an axis of the panel 1 in the horizontal direction hereinafter referred to as the "horizontal axis", V indicates an axis of the panel 1 in the vertical direction hereinafter referred to as the "vertical axis", D indicates an axis of the panel 1 in the diagonal direction hereinafter referred to as the "diagonal axis", and R/L indicates a reference line for the electron beam deflection. The reference line R/L is defined as follows: where two lines are drawn from centers of the diagonal edges 7*a* and 7*b* of the phosphor screen 7 opposite to each other to a point of a tube axis Z line such that the angle between the tube axis Z line and each of the two lines reaches half the maximum deflection angle, the reference line R/L is indicated by the line crossing the point of the tube axis Z line normal thereto.

As shown in FIG. 1, the panel 1 of the CRT has an inner phosphor screen 7 and a rear portion. The CRT also includes an electrode mask 13. A funnel 3 is connected to the rear portion of the panel 1. The funnel 3 is sequentially provided with a body 3*a* with a large-sized end 30*a* and a small-sized end 30*b*, and a cone portion 3*b* also with a large-sized end 30*c* and a small-sized end 30*d*. The body 3*a* meets the cone portion 3*b* at a point 30*e*, and the meeting point 30*e* of the body 3*a* and the cone portion 3*b* becomes an inflection point or the socalled top of round (TOR) of the funnel 3 at which the inner curved surface of the funnel 3 changes from depression (corresponding to the body 3*a*) to prominence (corresponding to the cone portion 3*b*). The funnel 3 is sealed to the rear portion of the panel 1 at the large-sized end 30*a* of the body 3*a*. A neck 5 is sealed to the small-sized end 30*d* of the cone portion 3*a*. An electron gun 11 is fitted within the neck 5 to produce electron beams. A deflection yoke 9 is mounted around the cone portion 3*b* of the funnel 3.

In consideration of the practical moving routes of the electron beams, the cone portion 3*b* of the funnel 3 is designed to have a thickness varying at different positions.

Specifically speaking, the cone portion 3*b* of the funnel 3 has a thickness Th in the horizontal axis H direction referred to hereinafter as the "horizontal thickness", a thickness Tv in the vertical axis V direction referred to hereinafter as the "vertical thickness", and a thickness Td in the diagonal axis D direction referred to hereinafter as the "diagonal thickness". The interrelation among Th, Tv and Td in the tube axis Z direction satisfies the following condition: $Th(z) \equiv Tv(z) > Td(z)$.

Figure 3:
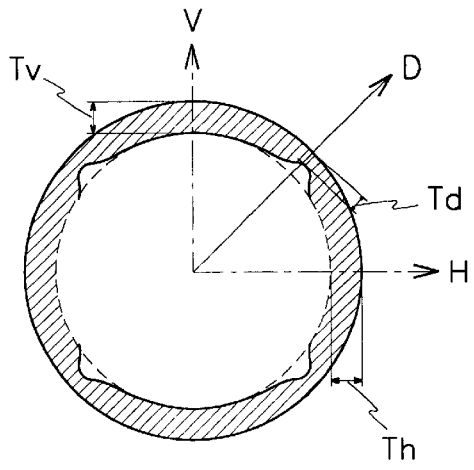
FIG. 3 is a sectional view of a cone portion of the funnel shown in FIG. 1.

As shown in FIG. 3, the horizontal thickness Th of the cone portion 3*b* is established to approximate the vertical thickness Tv in the tube axis Z direction while being larger than the diagonal thickness Td.

Figure 4:
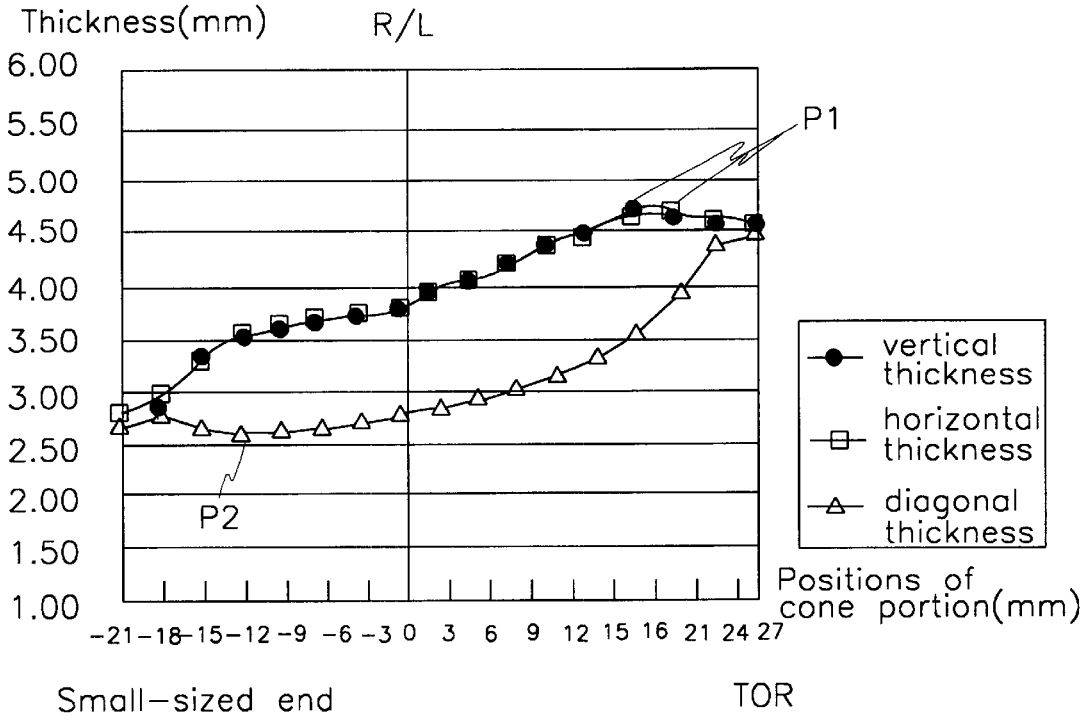
FIG. 4 is a graph illustrating the thickness variation of the cone portion of the funnel shown in FIG. 1 as a function of positions of the cone portion.

In FIG. 4, the positions of the cone portion 3*b* are indicated by numeric values while making the reference line R/L a zero point 0. As shown in FIG. 4, the cone portion 3*b* is structured such that the horizontal thickness Th and the vertical thickness Tv non-monotonically increase or decrease each with one or more maximum values P1 from the small-sized end 30*d* of the cone portion 3*b* to the inflection point 30*e* of the funnel 3. In contrast, the diagonal thickness Td is smaller than the horizontal thickness Th and the vertical thickness Tv, and non-monotonically increases or decreases with at least one minimum value P2.

The variation A Td of the diagonal thickness Td is established to be greater between the reference line RL and the inflection point 30*e* than between the small-sized end 30*d* of the cone portion 3*b* and the reference line R/L.

As the beam shadow neck phenomenon is mainly generated between the small-sized end 30*d* of the cone portion 3*b* and the reference line R/L in the wide-angled deflection of the electron beams, the diagonal thickness Td should be relatively smaller in that position range. Therefore, in this preferred embodiment, the variation $\Delta Td$ of the diagonal thickness Td between the small-sized end 30*d* of the cone portion 3*b* and the reference line R/L is established to be relatively small.

In this way, the cone portion 3*b* is designed to have a varying thickness corresponding to the practical routes of the electron beams so that the deflected electron beams do not strike the inner surface of the cone portion 3*b* but rather land on the appropriate phosphors on the phosphor screen 7.

Furthermore, owing to such a structure of the cone portion 3*b*, the deflection yoke 9 surrounding the cone portion 3*b* exerts a practical influence on the electron beams passing through the cone portion 3*b*, so that the power for deflecting the electron beams may be reduced, resulting in minimized power consumption.

In a second preferred embodiment, the overall components of the CRT are the same as those discussed in the first preferred embodiment except that the cone portion 3*b* of the funnel 3 is formed with a sectional shape varying from a circle to a non-circle while proceeding from the small sized end to the large sized end.

Figure 5:
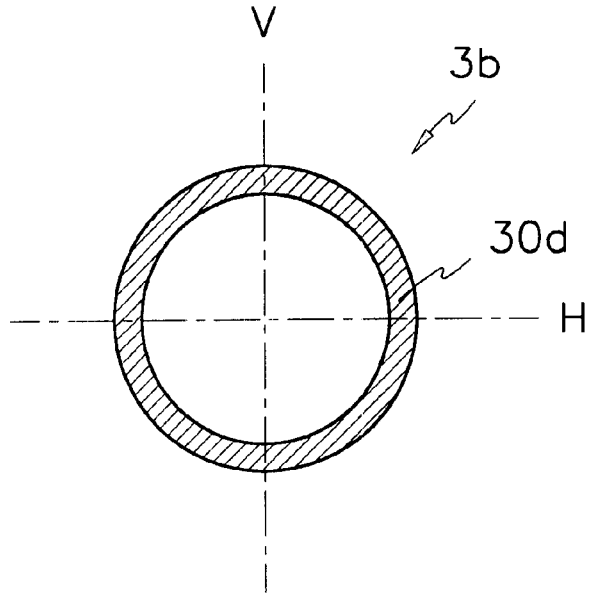
FIG. 5 is a sectional view of a cone portion of a funnel for a CRT according to a second preferred embodiment of the present invention.

As shown in FIG. 5, the small-sized end 30*d* of the cone portion 3*b* sealed to the neck 5 has a substantially circular sectional shape such that it has a diameter identical with that of the neck 5. In contrast, as shown in FIG. 6, the large-sized end 30*c* of the cone portion 3*b* has a non-circular sectional shape, such as a rectangle.

As in the first preferred embodiment, the cone portion 3*b* of the funnel 3 according to this preferred embodiment is designed to have a varying thickness in various directions.

Figure 6:
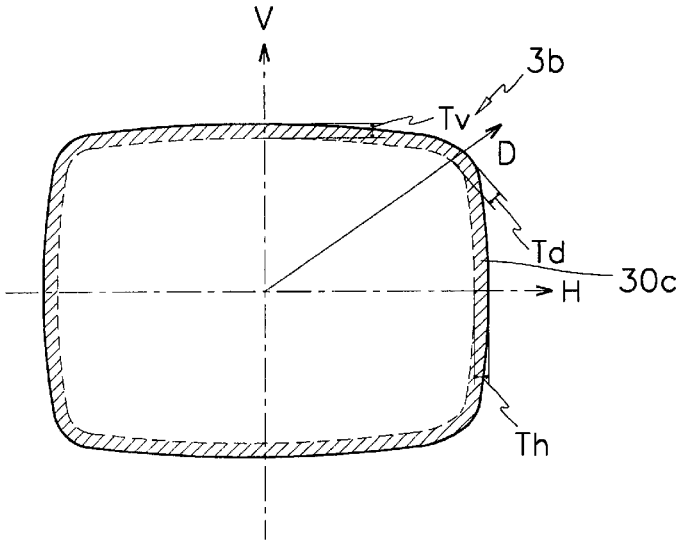
FIG. 6 is another sectional view of the cone portion shown in FIG. 5.

As shown in FIG. 6, the cone portion 3*b* of the funnel 3 has a thickness Th in the horizontal axis H direction, a thickness Tv in the vertical axis V direction and a thickness Td in the diagonal axis D direction. The inter-relationship among Th, Tv and Td in the tube axis Z direction satisfies the following condition: $Tv(z) > Th(z) > Td(z)$.

When the electron beams are deflected by the deflection yoke 9, the margin of deflection of the electron beams is greater in the vertical axis V direction than in the horizontal axis H direction and the diagonal axis D direction. Therefore, in this preferred embodiment, the vertical thickness Tv is established to be thicker than the horizontal thickness Th and the diagonal thickness Td.

Figure 7:
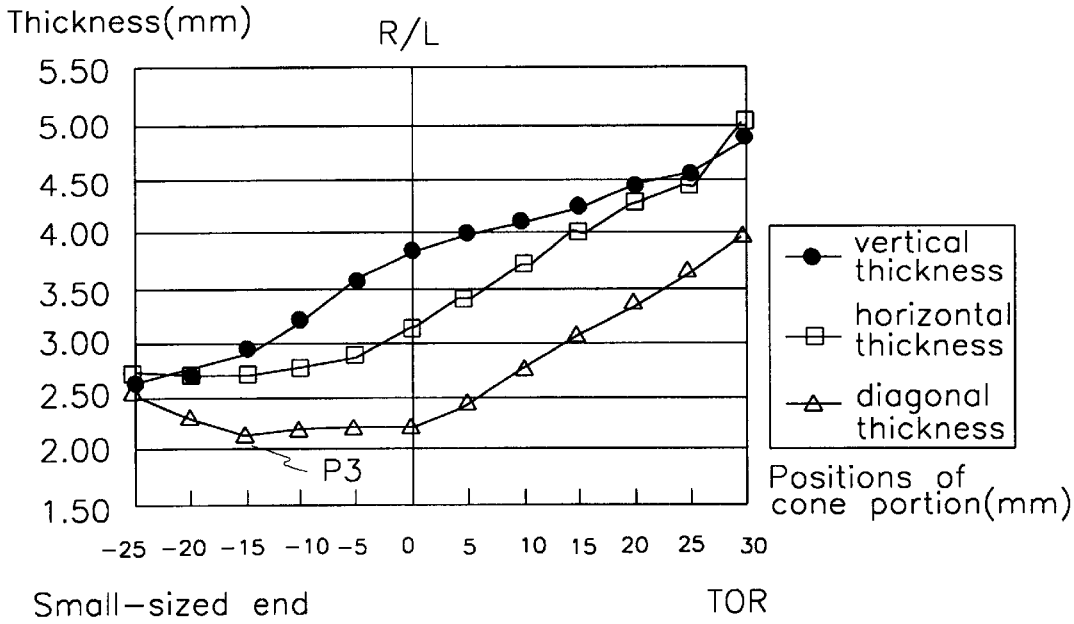
FIG. 7 is a graph illustrating the thickness variation of the cone portion shown in FIG. 5 as a function of positions of the cone portion.

FIG. 7 is a graph illustrating the thickness variation of the cone portion 3*b* shown in FIG. 5 as a function of the positions of the cone portion 3*b*. In the graph, the positions of the cone portion 3*b* are indicated by numeric values while making the reference line R/L a zero point 0.

As shown in FIG. 7, the cone portion 3*b* is structured such that the horizontal thickness Th and the vertical thickness Tv monotonically increase or decrease from the small-sized end 30*d* of the cone portion 3*b* to the inflection point 30*e* of the funnel 3. In contrast, the diagonal thickness Td non-monotonically increases or decreases with at least one minimum value P3.

Furthermore, in this preferred embodiment, the cone portion 3*b* is structured such that the difference between the horizontal thickness Th and the diagonal thickness Td (Th−Td), the difference between the vertical thickness Tv and the horizontal thickness Th (Tv−Th), and the difference between the vertical thickness Tv and the diagonal thickness Td (Tv−Td), should have maximum values in the range of 5 mm or less from the reference line R/L. This considers the practical routes of the electron beams and establishes the diagonal thickness Td to be smallest at the region of maximum beam deflection electron.

The variation ΔTd of the diagonal thickness Td is established to be greater between the reference line R/L and the inflection point 30*e* than between the small-sized end 30*d* of the cone portion 3*b* and the reference line R/L. Furthermore, the inter-relationship among the variation of the vertical thickness ΔTv, the variation of the horizontal thickness ΔTh, and the variation of the diagonal thickness ΔTd between the small-sized end 30*d* of the cone portion 3*b* and the reference line R/L is established to satisfy the following condition: ΔTv>ΔTh>ΔTd. In contrast, the inter-relation among ΔTv, ΔTh and, ΔTd between the reference line R/L and the inflection point 30*e* is established to satisfy the following condition: ΔTd>ΔTh>ΔTv.

As in the first preferred embodiment, the cone portion 3*b* of the funnel 3 for the CRT according to the second preferred embodiment of the present invention is designed to have a varying thickness corresponding to the practical routes of the electron beams so that the deflected electron beams do not strike the inner surface of the cone portion 3*b*, but rather land on the appropriate phosphors on the phosphor screen 7.

As described above, the inventive CRT can effectively enhance electron beam deflection efficiency by optimizing the thickness relationships of the different positions of the cone portion.

While the present invention has been described in detail with reference to the preferred embodiments, those skilled in the art will appreciate that various modifications and substitutions can be made thereto without departing from the spirit and scope of the present invention as set forth in the appended claims.

This application claims priority of Korean Application No. 98-48060 filed Oct. 11, 1998, the content of which is incorporated herein by reference.

What is claimed is:

1. A cathode ray tube having a central axis Z, the cathode ray tube comprising:

a panel with an inner phosphor screen and a rear portion, the panel having a substantially rectangular effective screen portion with two long sides in a horizontal axis direction, two short sides in a vertical axis direction and four edges in a diagonal axis direction;

a funnel connected to the rear portion of the panel, the funnel sequentially having a body with a large-sized end and a small-sized end, and a cone portion with a large-sized end and a small-sized end, the large-sized end of the body being sealed to the rear portion of the panel, the small-sized end of the body meeting the large-sized end of the cone portion at a point, the meeting point of the body and the cone portion being an inflection point of the funnel, the cone portion having a thickness Th(z) in the horizontal axis direction, a thickness Tv(z) in the vertical axis direction and a thickness Td(z) in the diagonal axis direction;

a neck sealed to the small-sized end of the cone portion;

an electron gun fitted within the neck to produce electron beams; and a deflection yoke mounted around the cone portion of the funnel;

wherein the horizontal thickness Th, the vertical thickness Tv and the diagonal thickness Td of the cone portion of the funnel in the tube axis Z direction over a substantial distance satisfy the following condition corresponding to practical routes of the electron beams in the diagonal axis direction: Th(z)≡Tv(z)>Td(z).

2. The cathode ray tube of claim 1 wherein the cone portion has a reference line for deflection of the electron beams defined as follows: where two lines are drawn from centers of the diagonal edges of the effective screen portion of the panel opposite to each other to a point of the tube axis Z line such that the angle between the tube axis Z line and each of the two lines reaches half the maximum deflection angle, the reference line R/L is indicated by the line crossing the point of the tube axis Z line normal thereto, and the diagonal thickness Td(z) of the cone portion in the tube axis Z direction varies between the reference line and the inflection point of the funnel in a greater degree than between the small-sized end of the cone portion and the reference line.

3. A cathode ray tube having a central tube axis Z, the cathode ray tube comprising:

a panel with an inner phosphor screen and a rear portion, the panel having a substantially rectangular effective screen portion with two long sides in a horizontal axis direction, two short sides in a vertical axis direction and four edges in a diagonal axis direction;

a funnel connected to the rear portion of the panel, the funnel sequentially having a body with a large-sized end and a small-sized end, and a cone portion with a large-sized end and a small-sized end, the large-sized end of the body being sealed to the rear portion of the panel, the small-sized end of the body meeting the large-sized end of the cone portion at a point, the meeting point of the body and the cone portion being an inflection point of the funnel, the cone portion having a thickness in the horizontal axis direction Th, a thickness in the vertical axis direction Tv, and a thickness in the diagonal axis direction Td;

a neck sealed to the small-sized end of the cone portion;

an electron gun fitted within the neck to produce electron beams; and a deflection yoke mounted around the cone portion of the funnel;

wherein the horizontal thickness Th and the vertical thickness Tv of the cone portion in the tube axis Z direction over a substantial distance non-monotonically increase or decrease each with one or more maximum values, and the diagonal thickness of the cone portion in the tube axis Z direction over a substantial distance non-monotonically increases or decreases with at least one minimum value corresponding to practical routes of the electron beams in the diagonal axis direction.

4. The cathode ray tube of claim 3 wherein the cone portion has a reference line for deflection of the electron beams defined as follows: where two lines are drawn from centers of the diagonal edges of the effective screen portion of the panel opposite to each other to a point of the tube axis Z line such that the angle between the tube axis Z line and each of the two lines reaches half the maximum deflection angle, the reference line R/L is indicated by the line crossing the point of the tube axis Z line normal thereto, and the diagonal thickness Td(z) of the cone portion in the tube axis Z direction varies between the reference line and the inflection point of the funnel in a greater degree than between the small-sized end of the cone portion and the reference line.

5. A cathode ray tube having a central axis Z, the cathode ray tube comprising:

a panel with an inner phosphor screen and a rear portion, the panel having a substantially rectangular effective screen portion with two long sides in a horizontal axis direction, two short sides in a vertical axis direction and four edges in a diagonal axis direction;

a funnel connected to the rear portion of the panel, the funnel sequentially having a body with a large-sized end and a small-sized end, and a cone portion with a large-sized end and a small-sized end, the large-sized end of the body being sealed to the rear portion of the panel, the small-sized end of the body meeting the large-sized end of the cone portion at a point, the meeting point of the body and the cone portion being an inflection point of the funnel, the cone portion having a sectional shape varying from a circle to a non-circle like a rectangle while proceeding from the small sized end to the large sized end, the cone portion having a thickness Th(z) in the horizontal axis direction, a thickness Tv(z) in the vertical axis direction and a thickness Td(z) in the diagonal axis direction;

a neck sealed to the small-sized end of the cone portion;

an electron gun fitted within the neck to produce electron beams; and a deflection yoke mounted around the cone portion of the funnel;

wherein the horizontal thickness Th(z), the vertical thickness Tv(z) and the diagonal thickness Td(z) of the cone portion of the funnel in the tube axis Z direction satisfy the following condition over a substantial distance corresponding to practical routes of the electron beams in the diagonal axis direction: $Th(z) \equiv Tv(z) > Td(z)$.

6. A cathode ray tube having a central tube axis Z, the cathode ray tube comprising:

a panel with an inner phosphor screen and a rear portion, the panel having a substantially rectangular effective screen portion with two long sides in a horizontal axis direction, two short sides in a vertical axis direction and four edges in a diagonal axis direction;

a funnel connected to the rear portion of the panel, the funnel sequentially having a body with a large-sized end and a small-sized end, and a cone portion with a large-sized end and a small-sized end, the large-sized end of the body being sealed to the rear portion of the panel, the small-sized end of the body meeting the large-sized end of the cone portion at a point, the meeting point of the body and the cone portion being an inflection point of the funnel, the cone portion having a sectional shape varying from a circle to a non-circle while proceeding from the small sized end to the large sized end, the cone portion having a thickness Th in the horizontal axis direction, a thickness Tv in the vertical axis direction and a thickness Td in the diagonal axis direction;

a neck sealed to the small-sized end of the cone portion;

an electron gun fitted within the neck to produce electron beams; and a deflection yoke mounted around the cone portion of the funnel;

wherein the cone portion has a reference line for deflection of the electron beams defined as follows: where two lines are drawn from centers of the diagonal edges of the effective screen portion of the panel opposite to each other to a point of a tube axis Z line such that an angle between the tube axis Z line and each of the two lines reaches half a maximum deflection angle, the reference line is indicated by the line crossing the point of the tube axis Z line normal thereto, and the horizontal thickness Th and the vertical thickness Tv of the cone portion in the tube axis Z direction over a substantial distance monotonically increase or decrease, and the diagonal thickness Td of the cone portion in the tube axis Z direction over a substantial distance non-monotonically increases or decreases with at least one minimum value corresponding to practical routes of the electron beams in the diagonal axis direction.

7. The cathode ray tube of claim 6 wherein the difference Th−Td between the horizontal thickness Th and the diagonal thickness Td, the difference Tv−Th between the vertical thickness Tv and the horizontal thickness Th, and the difference Tv−Td between the vertical thickness Tv and the diagonal thickness Td each have a maximum value in the range of 5 mm or less from the reference line.

8. The cathode ray tube of claim 6 wherein the diagonal thickness Td(z) of the cone portion in the tube axis Z direction varies between the reference line and the inflection point of the funnel in a greater degree than between the small-sized end of the cone portion and the reference line.

9. The cathode ray tube of claim 6 wherein the relationship among a variation of the vertical thickness ΔTv, a variation of the horizontal thickness Δ Th and a variation of the diagonal thickness ΔTd between the small-sized end of the cone portion and the reference line satisfies the following condition: $\Delta Tv > \Delta Th > \Delta Td$.

10. The cathode ray tube of claim 6 wherein the relationship among a variation of the vertical thickness ΔTv, a variation of the horizontal thickness Δ Th and a variation of the diagonal thickness ΔTd between the reference line and the inflection point satisfies the following condition: $\Delta Td > \Delta Th > \Delta Tv$.

11. A cathode ray tube, comprising:

a panel with an inner phosphor screen and a rear portion, the panel having a substantially rectangular effective screen portion with two sides in a first axis direction, two sides in a second axis direction, the two sides in the second axis direction being shorter than the two sides in the first axis direction, and four edges each connecting one of the sides in the first axis direction to one of the sides in the second axis direction;

a funnel having a body with a first end coupled to the rear portion of the panel, and a cone portion having a first end coupled to a second end of the body at an inflection point of the funnel, the cone portion having a first radial thickness in the first axis direction, a second radial thickness in the second axis direction, and a third radial thickness in a direction of a diagonal axis extending between two opposite edges;

a neck coupled to a second end of the cone portion;

an electron gun disposed within the neck; and a deflection yoke disposed around the cone portion of the funnel;

wherein the first and second radial thicknesses over a substantial distance of the cone portion non-monotonically increase or decrease in an axial direction each with at least one maximum value, and the third radial thickness over a substantial distance of the cone portion non-monotonically increases or decreases in the axial direction with at least one minimum value corresponding to practical routes of the electron beams in the diagonal axis direction.

12. The cathode ray tube of claim 11 wherein the thickness of the cone portion in the axial direction varies more between a radial reference line and the inflection point of the funnel than between the second end of the cone portion and the radial reference line, the reference line being defined at a point along an axial axis of the cathode ray tube where two lines extending from centers of opposite diagonal edges of the effective screen portion of the panel meet such that an angle between the axial axis and each of the two lines is half a maximum electron deflection angle.

13. A cathode ray tube, comprising:

a panel with an inner phosphor screen and a rear portion, the panel having a substantially rectangular effective screen portion with two sides in a first axis direction, two sides in a second axis direction, the two sides in the second axis direction being shorter than the two sides in the first axis direction, and four edges each connecting one of the two sides in the first axis direction with one of the two sides in the second axis direction;

a funnel having a body with a first end coupled to the rear portion of the panel, and a cone portion having a first end coupled to a second end of the body at an inflection point of the funnel, the cone portion having a cross section that changes from circular away from the panel to non-circular toward the panel, the cone portion further having a first radial thickness in the first axis direction, a second radial thickness in the second axis direction and a third radial thickness in a direction of a diagonal axis extending between two opposite edges;

a neck coupled to a second end of the cone portion;

an electron gun disposed within the neck to produce electron beams; and a deflection yoke disposed around the cone portion of the funnel;

wherein the cone portion has a reference line defined at a point along an axial axis of the cathode ray tube where two lines extending from opposite diagonal edges of the effective screen portion of the panel meet such that an angle between the axial axis and each of the two lines is half a maximum electron deflection angle; and wherein the first radial thickness and the second radial thickness of the cone portion monotonically increase or decrease in an axial direction over a substantial distance, and the third radial thickness of the cone portion non-monotonically increases or decreases in the axial direction over a substantial distance with at least one minimum value corresponding to practical routes of the electron beams in the diagonal axis direction.

14. The cathode ray tube of claim 13 wherein the difference between the first radial thicknes's and the third radial thickness, the difference between the second radial thickness and the first radial thickness, and the difference between the second radial thickness and the third radial thickness each have a maximum value along the axial axis within 5 mm or less from the reference line.

15. The cathode ray tube of claim 13 wherein the third radial thickness of the cone portion varies more between the reference line and the inflection point of the funnel than between the second end of the cone portion and the reference line.

16. The cathode ray tube of claim 13 wherein the variation of the second radial thickness is greater than a variation of the first radial thickness and the variation of the first radial thickness is greater than the variation of the third radial thickness between the second end of the cone portion and the reference line.

17. The cathode ray tube of claim 13 wherein the variation of the third radial thickness is greater than the variation of the first radial thickness, and the variation of the first radial thickness is greater than the variation of the second radial thickness between the reference line and the inflection point.

* * * * *